United States Patent [19]

Milianowicz

[11] 4,289,942

[45] Sep. 15, 1981

[54] GAS-BLAST CIRCUIT-INTERRUPTER WITH MULTIPLE INSULATING ARC-SHIELD CONSTRUCTION

[75] Inventor: Stanislaw A. Milianowicz, Monroeville, Pa.

[73] Assignee: Westinghouse Electric Corp., Pittsburgh, Pa.

[21] Appl. No.: 820,176

[22] Filed: Jul. 29, 1977

[51] Int. Cl.[2] ..... H01H 33/88

[52] U.S. Cl. ..... 200/148 A; 200/150 G

[58] Field of Search ..... 200/148 A, 150 G, 148 R

[56] References Cited

U.S. PATENT DOCUMENTS

| | | | |
|---|---|---|---|
| 3,291,948 | 12/1966 | Telford | 200/148 A |
| 3,582,589 | 6/1971 | Frink | 200/148 A |
| 3,659,065 | 4/1972 | Roidt et al. | 200/148 A |
| 3,708,639 | 1/1973 | Vigreux et al. | 200/148 R |
| 3,906,180 | 9/1975 | Glarner | 200/148 A |

*Primary Examiner*—Robert S. Macon

*Attorney, Agent, or Firm*—M. J. Moran

[57] ABSTRACT

A gas-blast circuit-interrupter of the "puffer" -type has a pair of separable contacts, at least one of which is movable, and a movable multiple insulating arc-shield assembly, or multiple hollow nozzle assembly, is movable during the opening operation with said movable contact, and initially delays the radial inward ejection of compressed gas from the piston chamber into the arcing region, until an adequate time has elapsed for sufficient arc lengthening to take place for circuit interruption.

22 Claims, 11 Drawing Figures

ARCING POSITION

ARCING POSITION

GAS-BLAST CIRCUIT-INTERRUPTER WITH MULTIPLE INSULATING ARC-SHIELD CONSTRUCTION

CROSS-REFERENCE TO RELATED APPLICATIONS

Reference may be had to U.S. patent application filed May 13, 1974, Ser. No. 469,586, by Stanislaw A. Milianowicz, entitled "Improved Puffer-Type Gas Circuit-Interrupter".

Reference may also be had to the following patent applications: U.S. patent application filed May 3, 1974, Ser. No. 466,745 by Steven Swencki and Stanislaw A. Milianowicz; U.S. patent application filed July 31, 1967, Ser. No. 657,122 by Russell E. Frink and Stanislaw A. Milianowicz, all of the foregoing patent applications being assigned to the assignee of the instant patent application.

Moreover, U.S. patent application filed May 14, 1974, Ser. No. 469,932, by Russell E. Frink, relates to a lazy-tong, or pantograph type of operating mechanism, and an improved operating seal for a sealed puffer-type of interrupter unit, or casing, which provides thereby a considerably lengthened movable contact travel distance with a relatively-short minimal, axial initiating operating movement of the connecting rod, which initiates movement of the said lazy-tong linkage, for example, from the externally-located actuating operating mechanism.

BACKGROUND OF THE INVENTION

Puffer-type circuit-interrupters utilizing a movable operating-cylinder, carrying a nozzle structure and a movable contact structure, and sliding over a relatively fixed piston member are well known in the art. Reference may be had to U.S. Pat. No. 2,757,261, issued July 31, 1956, to Lingal et al, and also to U.S. Pat. No. 2,788,418, issued Apr. 9, 1957, to Owens et al. Additional interrupting structures are set forth in U.S. Pat. No. 3,588,407, issued June 28, 1971 to Frink et al, the latter patent illustrating a movable piston member carried by an operating cylinder, and sliding over a fixed orifice member to inject compressed gas into a pair of separable tubular venting contacts. Valve action provided between two vented contacts separable to establish arcing is shown in the aforesaid Frink et al U.S. Pat. No. 3,588,407, and also in Leeds U.S. Pat. No. 3,769,479, issued Oct. 30, 1973. Of interest also, is U.S. Pat. No. 3,814,883, issued Nov. 3, 1972, to Stanislaw A. Milianowicz and assigned to the assignee of the instant invention. See, also, U.S. Pat. No. 3,588,407, issued June 28, 1971, to Frink et al.

It is desired in the present invention to effect certain interrupting improvements in puffer-type interrupters as contrasted with the "puffer-type" circuit-interrupters of the foregoing patents, and also the prior art, to enable them to more effectively and quickly interrupt high-magnitude charging and magnetizing currents even at high voltages, while at the same time not requiring additional series breaks in the circuit.

SUMMARY OF THE INVENTION

In accordance with the present invention, there is provided a movable operating cylinder carrying a movable multiple hollow insulating nozzle, or movable arc-shield assembly, and a movable arcing contact, the entire movable assembly moving as a unitary assemblage, and sliding over a relatively-stationary fixed piston member, the latter being supported adjacent one end of an enclosing interrupter-casing structure containing, preferably, a highly efficient arc-extinguishing gas, such as sulfur-hexafluoride ($SF_6$) gas, for example. A cooperable relatively-stationary contact is provided, preferably being of hollow configuration, so as to provide a desirable venting path therethrough, and functioning during the arcing interval, to exhaust gases out from the arcing region to the outer gas ambient, or atmosphere within the outer enclosing interrupter sealed casing structure. For certain applications, where desired, the stationary contact may, however, be solid or non-vented.

For the high-power and high-voltage ratings, preferably, there are provided three hollow movable insulating nozzles, or arc shields, provided with radially-inwardly-directed gas-inlet passages communicating with the piston chamber, in which gas is compressed by the relative operation of the movable operating cylinder over the fixed piston member, or structure and compressing gas therebetween.

One of the hollow movable insulating nozzles is disposed immediately adjacent the movable contact, which is preferably also vented. An intermediate movable hollow insulating nozzle is spaced axially away from the first-mentioned movable nozzle to provide an annular gas-inlet passage therebetween, and a third hollow insulating movable nozzle is additionally provided at the forward end of the movable operating-cylinder assembly, again spaced axially away from the second, or intermediate movable hollow nozzle to provide thereby a second radially-inwardly-extending gas-inlet passage therebetween, that is between the third and second, or intermediate movable hollow insulating nozzle.

In the closed-circuit position of the interrupting device, the three hollow movable insulating nozzles encompass, or encircle the relatively-stationary contact, which is preferably vented, to provide an exhaust, or venting passage for arced gases therethrough during the initial stages of the opening operation. The gas-inlet passages are blocked off in the closed-circuit position of the device, and also during the time of initial establishment of the arc, until the separable contact structure has separated sufficiently to enable a withdrawal of the relatively-stationary vented contact out from the first hollow movable insulating nozzle to thereby uncover the first movable gas-inlet passage. Gas flow out of the piston chamber can now ensue. At a subsequent point in time, the vented stationary contact uncovers the second, or middle hollow movable nozzle to thereby vent, or uncover the second radially-inwardly-extending movable inlet passage. At this point in time, there is now uncovered two radially inwardly-extending movable inlet passages prior to the point in time at which the stationary contact is withdrawn out from the third, or forward-end hollow movable insulating nozzle.

A movable metallic cooler assembly is additionally provided, in conjunction with the first and second radially-inwardly extending movable inlet passages, to not only cool the compressed gas, which is ejected into the arcing passage from the piston chamber, but also to cooperate in cooling the arced gas, which backflows into the movable gas-inlet passages during high instantaneous current values, when the arcing pressure, in fact, may possibly overcome the piston pressure. This possible oscillatory gas movement is quite rapid, and the movable metallic cooler member assists in cooling the hot arced gases during this possible gas-backflow action to cool the gases for the subsequent period of time in which they may again pass back into the arcing region during low-instantaneous current conditions.

For relatively low-power and low-current ratings, instead of having three insulating movable nozzles moving together, two such movable hollow insulating nozzles may be provided, instead of three, when desired, for effectively providing interruption of relatively low-power circuitbreakers.

DESCRIPTION OF THE PREFERRED EMBODIMENTS

Figure 1:
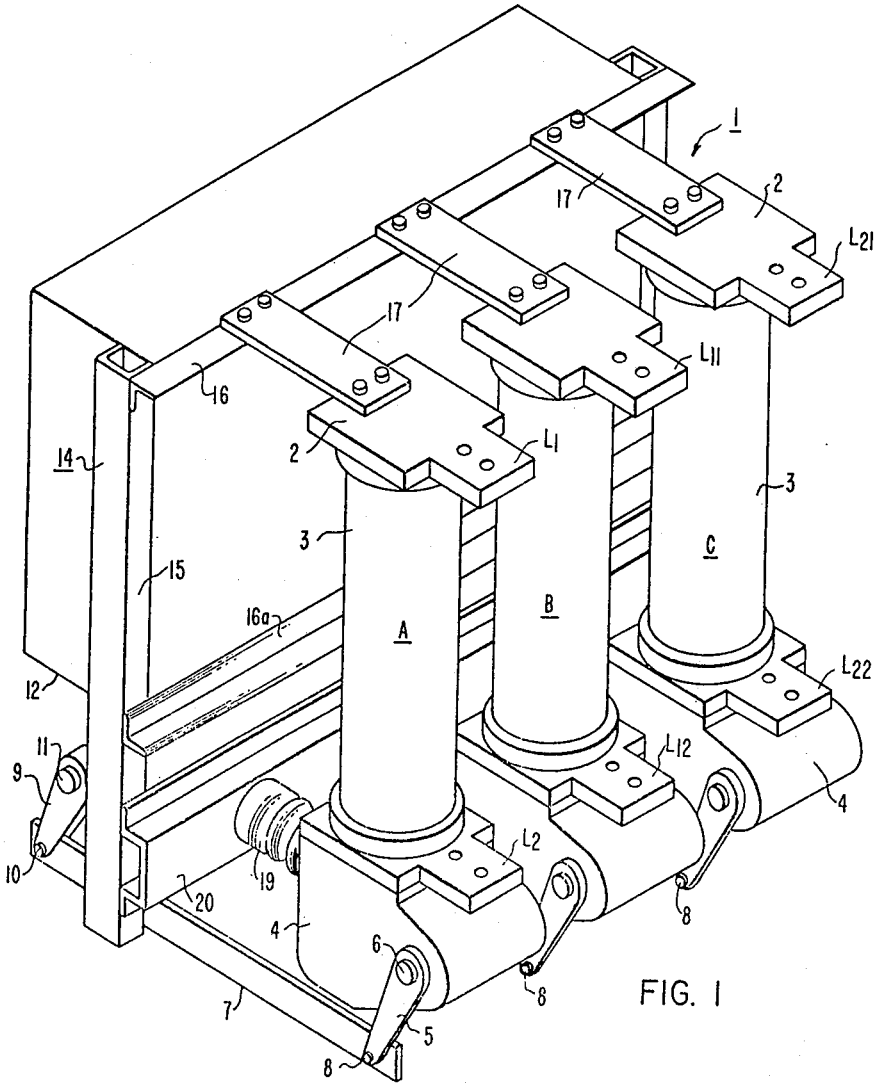
FIG. 1 illustrates a perspective view of a three-pole, gas-blast, puffer-type circuit-interrupting assemblage embodying the principles of the present invention, with the contact structure being illustrated in the fully-open-circuit position.

Referring to the drawings, and more particularly to FIG. 1 thereof, the reference numeral 1 generally designates a three-pole fluid-blast circuit-interrupter comprising three spaced pole-assemblies "A", "B" and "C". As will be apparent from FIG. 1, each pole-assembly includes, generally, an upper end plate 2, a generally upstanding cylindrical housing 3, and a lower end plate and mechanism housing 4. Disposed exteriorly of the mechanism housing 4 is a drive-crank 5 affixed to an operating shaft 6, and a generally horizontally reciprocally movable insulating operating rod 7 is pivotally secured to the external operating crank 5, as at 8, and is connected to a drive-crank 9 through a pivotal connection 10. The three drive-cranks 9, only one of which is shown, are affixed and rotatable with an operating drive-shaft 11, which is connected to a suitable mechanism 12, which constitutes no part of the present invention, and may be of the type set forth in U.S. Pat. No. 3,183,332, issued May 11, 1965 to Russell E. Frink and Paul Olsson, and assigned to the assignee of the present invention.

It will be apparent from FIG. 1 that a suitable supporting grounded framework 14 is utilized comprising vertical channel members 14 with interbracing structural steel members 16, **16*a* having horizontally-extending insulating support straps 17 secured thereto, which assist in supporting the interrupting assemblies. Additionally, lower insulator supports 19 may be employed extending generally horizontally from a channel-support member 20, the latter being affixed to the vertical support channels 15**.

Figure 2:
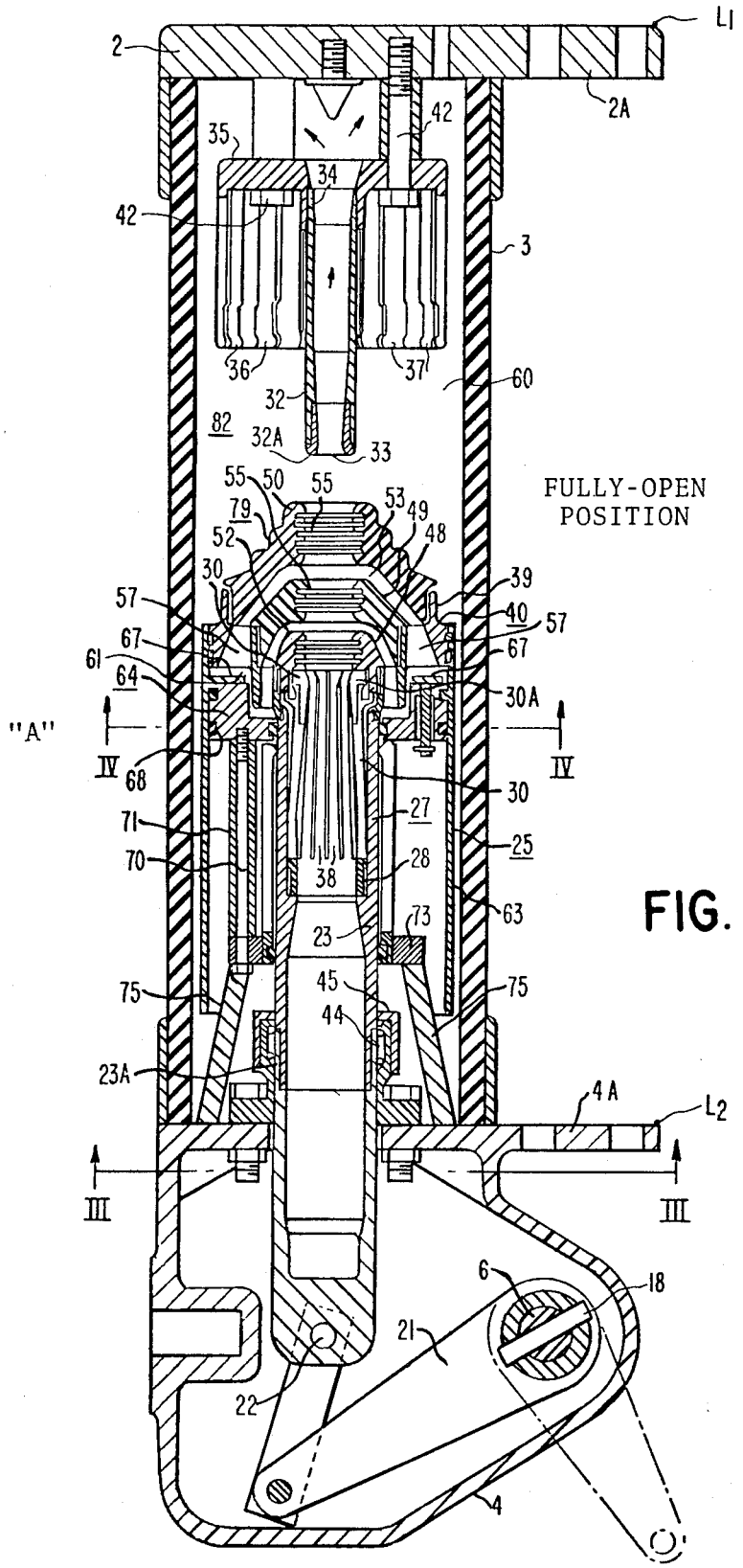
FIG. 2 is a considerably-enlarged longitudinal vertical sectional view taken through one of the pole-units of FIG. 1, the separable contact structure being illustrated in the fully-open-circuit position.
Figure 5:
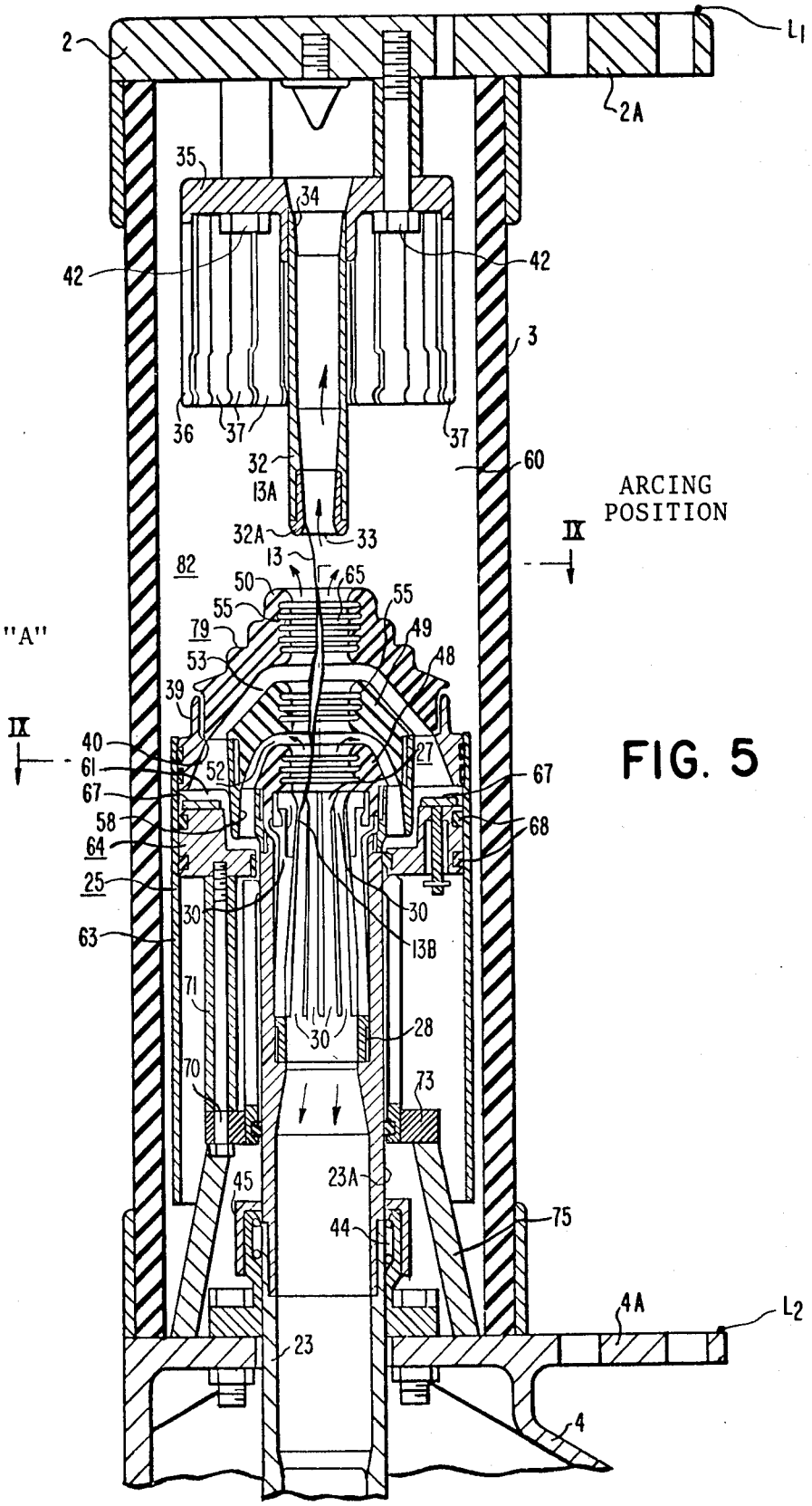
FIG. 5 is a fragmentary, enlarged, vertical sectional view taken through the pole-unit of FIG. 2, with the movable contact structure opening and the view showing the arcing position of the contact structure.

FIGS. 2 and 5 more clearly illustrate the internal construction of each of the interrupting assemblies. With reference to FIG. 2, it will be noted that there is provided the cylindrical housing 3 of a suitable insulating material having at the upper end thereof the end closure plate 2 having a line-terminal connection **2*a* constituting an integral part thereof. At the opposite, lower end of the tubular housing 3 is the operating casting housing 4, within which extends the rotatable operating shaft 6, having affixed thereto, as by a key pin 18, an internally-disposed operating crank 21, the latter being pivotally connected, as at 22, to a lower movable hollow vented contact rod 23 carrying a movable operating cylinder assembly 25** therewith.

As shown more clearly in FIG. 5, the movable operating-cylinder assembly 25 comprises a hollow vented tubular movable arcing contact 27, which may be fabricated out of a generally-slotted tubular member 28 to form a plurality of resilient movable arcing contact fingers 30, which collectively engage the outer sides of a relatively-stationary hollow tubular vented arcing contact 32 having at its forward end **32*a* a tubular arcing insert 33** of arc-resisting material, such as copper-tungsten alloy, or the like.

The relatively-stationary tubular vented contact 32 may be affixed, as by brazing at 34, for example, to an upper apertured annular plate 35, which is affixed by bolts 42 to the upper end of the casing assembly 3 of FIG. 1.

Figure 9:
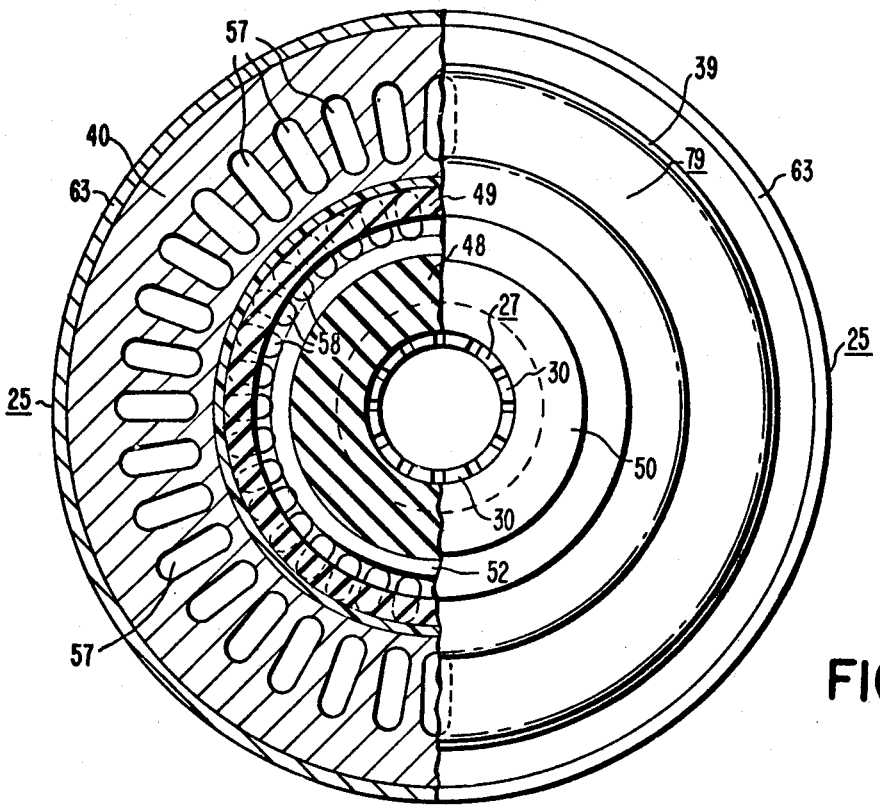
FIG. 9 is a partly end elevational sectional view taken along the broken sectional line IX—IX of FIG. 5.
Figure 3:
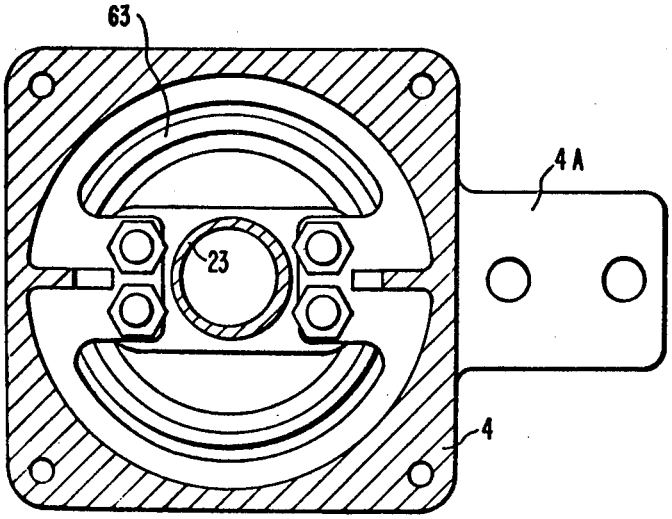
FIG. 3 is a sectional view taken substantially along the line III—III of FIG. 2.
Figure 4:
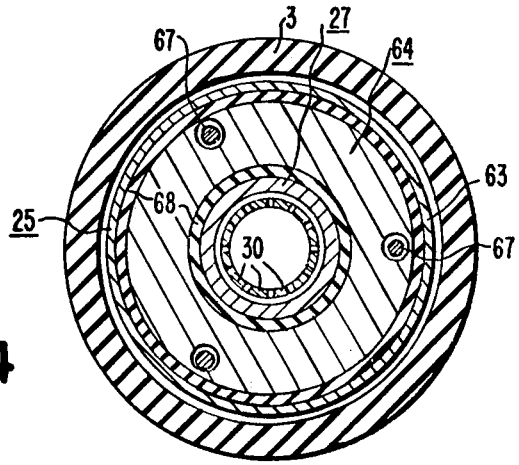
FIG. 4 is a sectional view taken substantially along the line IV—IV of FIG. 2.
Figure 6:
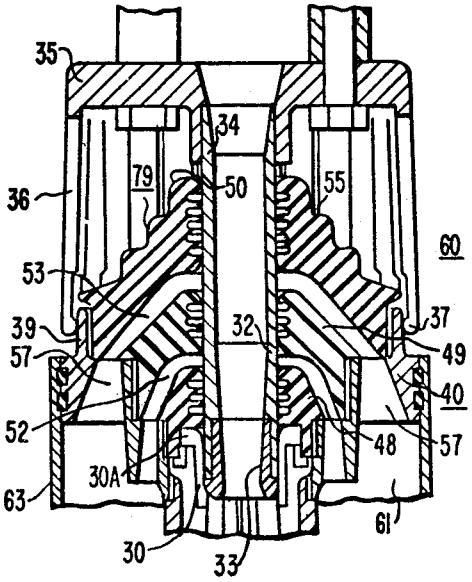
FIGS. 6, 7 and 8 fragmentarily illustrate successive contact positions during the opening stroke of the circuit-interrupter.

Extending downwardly from the upper support plate 35 is a set, or cluster 36 of circumferentially-disposed main stationary contact fingers 37, which make good contacting engagement, as shown in FIG. 6, with a movable main contact portion 39, which, if desired, may be integrally formed with an annular metallic movable cooler member 40, having a configuration more clearly illustrated in FIG. 9.

In the closed-circuit position of the circuit-interrupter 1, as illustrated more clearly in FIG. 6, it will be observed that the transmission-line current $L_1$, $L_2$ passes through each pole-unit "A", "B" or "C" by way of the upper terminal plate 2, mounting bolts 42, upper end stationary support plate 35, relatively-stationary main contact fingers 37, movable annular main contact 39, through the movable metallic cooler casting member 40, and through the hollow movable vented contact-rod 23 to the plurality of lower-disposed contact balls 44 interposed between a surrounding housing cage 45 and the outer surfaces **23*a* of the tubular movable contact 23. U.S. Pat. No. 3,301,986 illustrates the general construction of such a stationary sliding contact-ball structure 44. The current then flows through the lower conducting plate portion 4*a* of lower casting housing member 4** to the lower laterally-projecting line terminal $L_2$.

It will be observed that in the specific embodiment set forth in FIG. 2, that there is provided three seriallyrelated hollow movable insulating nozzles 48, 49 and 50, the intermediate one 49 of which is axially spaced away from the first and third nozzles 48, 50 by annular radially-inwardly-extending first and second gas-inlet passages 52 and 53. The first hollow movable insulating nozzle 48 is disposed immediately adjacent to the forward end 30*a* of the movable arcing contact fingers 30, which resiliently receive the stationary vented contact 32 in the closed-circuit position, as illustrated in FIG. 6.

The second, or intermediate insulating hollow movable insulating nozzle, or arc-shield 49 comprises an internally-corrugated member having corrugations 55 provided on the inner surface thereof, as shown. The forward, or third hollow movable insulating nozzle 50 is also corrugated, as at 55, and is axially spaced away from the intermediate, or second hollow movable nozzle 49 to provide a second inlet gas passage 53.

Both the first and second radially-inwardly-extending gas-inlet passages 52, 53 communicate with an apertured metallic movable cooler member 40, which may, if desired, be fabricated from a suitable casting of copper, or the like.

The two gas-inlet passages 52, 53 communicate, as shown in FIG. 2, with the apertures 57, provided in the metallic cooler member 40, so that compressed gas 60, compressed within the piston chamber 61, between the movable tubular operating cylinder 63 and the fixed piston member 64, will be forced through the cooling apertures 57, to pass through the first and second gas-inlet passages 52, 53 and into the arcing region, generally designated by the reference numeral 65 in FIG. 5, to extinguish the arc 13.

Preferably, a plurality of circumferentially-arranged, or located one-way-acting inlet valves 67 are provided, being associated with the forward, upper end of the fixed piston structure 64, to enable gas 60 to pass into the piston chamber 61 during the upward closing operation of the circuit-interrupter 1, yet to prevent the downward outward, exhausting flow of such compressed gas 60 during the opening compressing stroke of the circuit-interrupter 1. In addition, piston-rings 68 may be provided, as desired, between the fixed piston 64 and the movable operating cylinder 63, which may be formed from any suitable insulating material, such as "Teflon", for example.

As shown in FIG. 2, the fixed piston structure 64 comprises an annular metallic member supported by longitudinally-extending support-bolts 70 and longitudinal spacing sleeves 71 from a lower support plate 73, the latter being affixed to the lower mechanism casting member 4 by a suitable means, such as support posts 75, for example.

OPENING SEQUENCE

Figure 7:
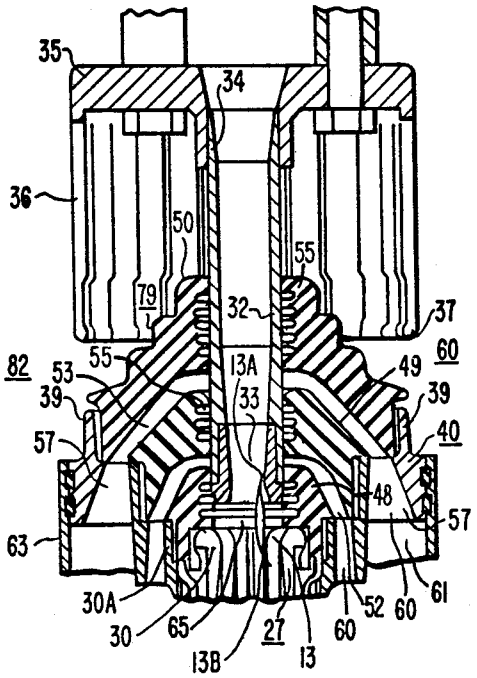

The closed-circuit position of the circuit-interrupter 1 is illustrated in FIG. 6. During the opening operation, the rotatable crank 21 forces the movable operating cylinder 63 and the movable arcing contact structure 27 downwardly to the position shown in FIG. 7. During this time it will be observed that the first hollow insulating nozzle member 48 blocks any entrance of compressed gas 60 into the arcing region 65 by the valve, or blocking action occurring between the hollow tubular stationary arcing venting contact 32 and the first gas-inlet passage 52. An arc 13 is established immediately upon separation of the tip portions of the two arcing contacts 27 and 32, but venting only occurs at this time through the hollow tubular vented contacts 27 and 32 themselves, and entrance of compressed gas from the piston chamber 61 is, as mentioned, prevented by the aforesaid blocking, or valving action of the stationary tubular arcing contact 32 within the first hollow nozzle member 48.

Figure 8:
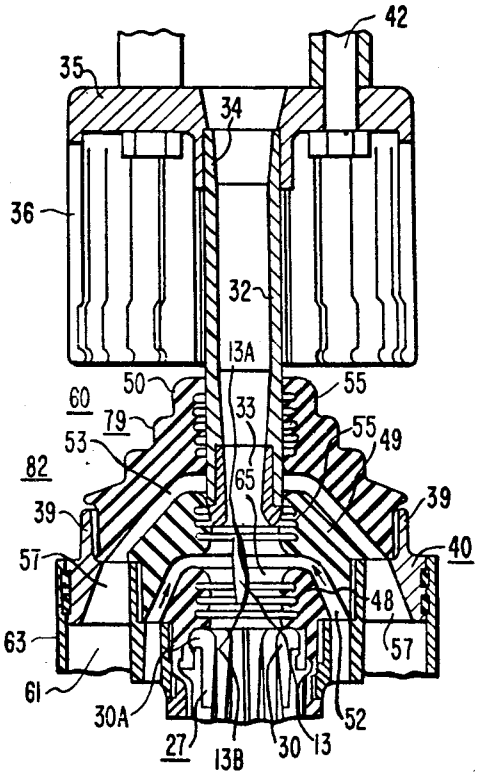

At a subsequent point of time, as shown in FIG. 8, the first insulating hollow nozzle 48 clears the tip extremity of the stationary arcing contact 32, and at this point in time, the compressed gas 60 is permitted to pass through the first gas-inlet passage 52, and into the arcing region 65. However, if the current is during this time at its high instantaneous current value, such instantaneous current magnitude may generate sufficient heat and pressure within the arcing region 65 so as to cause a backflow of heated gas by the arcing conditions back into the piston chamber 61 in a reverse direction, and through the first gas-inlet passage 52. This occurs because the contact separation at this point in time is not sufficient to enable the arc 77 to assume sufficient length to enable arc interruption to ensue.

Continued opening travel of the movable arcing contact structure 27 and the multiple nozzle assembly 79 will cause the second intermediate insulating nozzle 49 to be withdrawn from the stationary arcing contact 32 so as to uncover the second gas-inlet passage 53, as shown in FIG. 5. At this point in time, depending upon the current magnitude, current rating of the device and voltage supplied, interruption may occur. However, if arc interruption does not occur, it may happen that the hot arcing gases under high pressure will again cause a backflow through the second inlet passage 53, again back into the piston chamber 61. It will be observed that during the aforesaid oscillatory movement of gas flow back into the piston chamber 61 during high values of instantaneous current, for example, that the gas is caused to pass through the cooling apertures 57, provided in the metallic cooler assembly 40, which cools the gas 60 and extracts heat from this heated gas. In addition, the pressure is increased within the piston chamber 61.

During the time that the stationary arcing contact 32 is being withdrawn out of the second hollow insulating movable nozzle 49, and onward in its continued increasing contact-separation travel, arc interruption is a distinct possibility. It will be observed that during this time contact separation is now adequate enough for arc interruption to occur. Additionally, the gas is now under an increased pressure within the piston chamber 61, and by passing through the metallic cooler assembly 40, and back into the gas-inlet passages 52 and 53, the cooled gas 60 enters radially inwardly into the arcing region 65 to thereby effect quick interruption of the drawn arc 13, which at this point in time is now of considerable length, as shown in FIG. 5. Moreover, it will be observed that venting, or exhausting of gas 60 occurs through the stationary and movable tubular arcing venting contacts 27, 32, causing the tip terminal ends 13A, 13B of the arc 13 itself to pass into the interior of the tip portions of the stationary and movable arcing contacts 27, 32, generating still a lengthened arcing condition, and causing an axial flow of compressed gas past the tip portions 13A, 13B of the arc 13, and out in opposite directions through the hollow tubular arcing contacts 27 and 32.

In addition to the foregoing compressed-gas flow action, there will, of course, be an outward passage of compressed gas 60, as indicated by the arrows 80, into the gas ambient 82 externally of the hollow nozzle assembly 79, and internally of the outer surrounding insulating casing structure 3. This added compressed-gas flow, together with the exhausting of heated gas through the arcing contacts 27, 32 themselves quickly causes arc interruption to occur.

Figure 10:
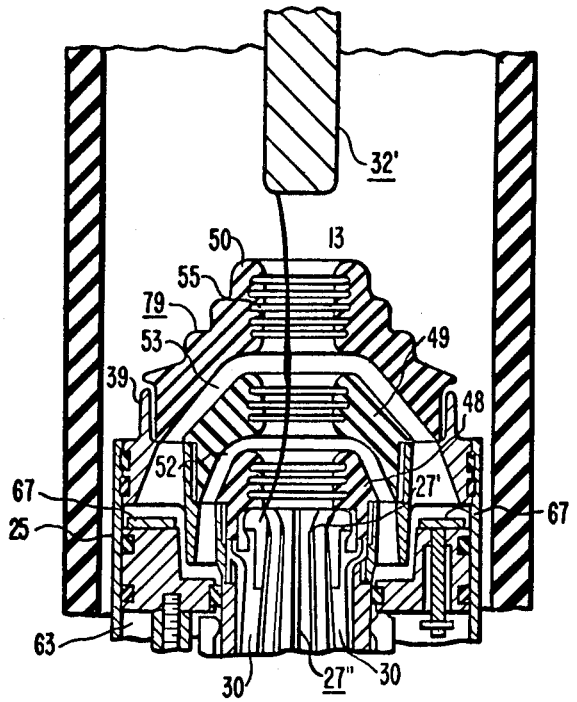
FIG. 10 illustrates a modification of the invention, in which a solid non-vented stationary contact is utilized, instead of a vented, hollow, stationary contact, the contact structure being illustrated in the partly-open-circuit position; and, FIG. 11 illustrates a modification of the invention in which only a pair of movable nozzles are employed, instead of three movable nozzles, as illustrated in FIGS. 5–8, again the contact structure being illustrated in the partly-open circuit position.

FIG. 10 shows an alternate arrangement in which the stationary contact 32' is solid, or non-vented. The movable contact 27' is, in this modification, vented as at 27'' to enable venting of the arced gases during the initial stages of arcing.

Figure 11:
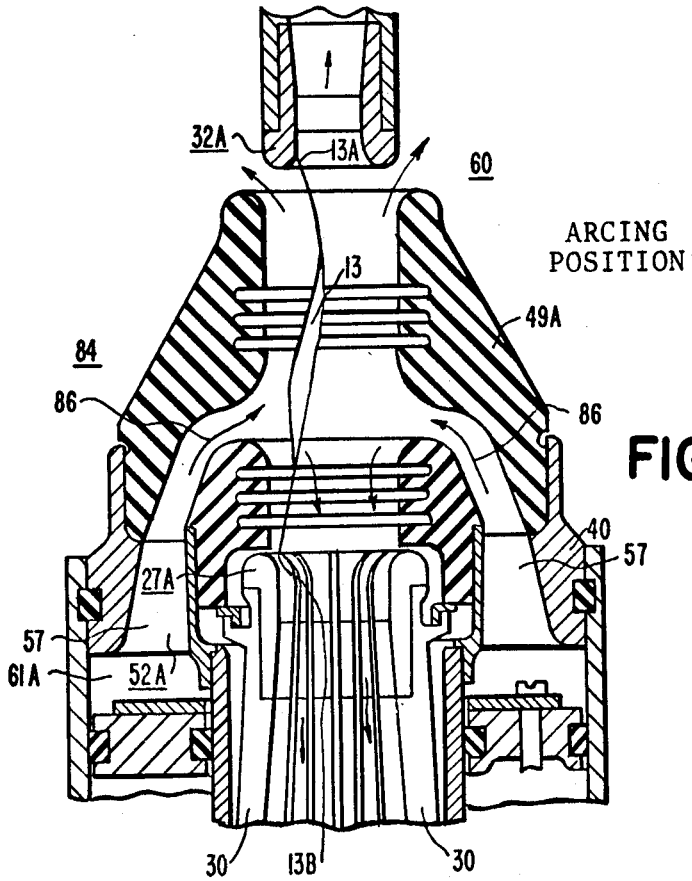

For the lower ratings, and for reduced power requirements, with a consequent lower voltage and current level, a two-nozzle arrangement 84, as illustrated in FIG. 11, may be adequate. The interrupting action in this case is somewhat similar to that as described above for the three multiple hollow nozzle assembly 79. As will be obvious, during the initial stages of arc drawing, the stationary arcing contact 32*a* again blocks the gas-inlet passage 52*a* preventing compressed gas flow out of the piston chamber 61*a*, yet permitting adequate venting of the gas 60 through the stationary and movable tubular arcing venting contacts 27*a*, 32*a*. However, upon withdrawal of the stationary arcing contact 32*a* out of the forward, or second hollow insulating movable nozzle 49*a*, arc interruption occurs both by the entrance of compressed gas through the gas-inlet passage 52*a*, as illustrated in FIG. 11, by the arrows 86. There also occurs an axial flow of compressed gas through the hollow separable contacts 27*a*, 32*a* themselves, as indicated by the arrows 88 in FIG. 11.

From the foregoing description it will be apparent that an improved multiple movable nozzle assembly 79 is provided enabling a desirable blocking, or valving action to take place prior to the withdrawal of the stationary arcing contact 32 out of the first hollow insulating movable nozzle 48. However, during this blocking action, the compressed gas is permitted to flow through the contacts 27, 32 themselves, as indicated by the arrows 90.

Depending upon the power and voltage requirements, a second and third movable nozzle may be utilized, with the compressed gas passing through the first, or second gas-inlet passages 52, 53, and also the gas, of course, being ejected, or exhausted axially out of the separable tubular arcing venting contacts 27 and 32 themselves.

The interrupting device, utilizing the three hollow movable nozzle arrangement 79 may be used for interrupting 50 KA, and having a line-to-line voltage rating of 138 KV, for example. It is particularly desirable for use in the interruption of short-line faults, with associated high values of transient recovery voltage. High-pressure differentials may be obtained by using the arc energy itself, resulting in the aforesaid oscillatory action, but the hot arc gases being cooled by the provision of the annular metallic cooler assembly.

Although there has been illustrated and described specific structures, it is to be clearly understood that the same were merely for the purpose of illustration, and that changes and modifications may readily be provided therein by those skilled in the art, without departing from the spirit and scope of the invention.

I claim:

1. A gas-type puffer circuit-interrupting structure including, in combination, means defining casing means, a relatively stationary contact-rod disposed within said casing means, means defining a fixed piston structure disposed within the casing means, a movable operating cylinder assembly carrying a movable contact and operatively slidable over said fixed piston structure to compress gas therebetween within a piston chamber for arc-extinction purposes, a multiple hollow insulating nozzle assembly also affixed to said movable operating cylinder assembly and surrounding said relatively stationary contact-rod in the closed circuit position of the circuit-interrupting structure, said movable nozzle assembly including at least a pair of axially-spaced insulating nozzles defining a gas-inlet passage therebetween, said gas-inlet passage being in communication with said piston chamber, one nozzle being situated close to the tip of the movable contact so that said stationary contact-rod blocks said gas-inlet passage in the closed-circuit position of the circuit-interrupting structure when the two aforesaid separable contacts are in closed contacting engagement, means effecting opening movement of said operating cylinder assembly during the opening operation of the circuit interrupting structure so that said movable operating cylinder assembly slides over said fixed piston structure to thereby simultaneously effect contact separation and also compression of gas within said piston chamber, and the blocking action of said rod-shaped stationary contact within said one insulating nozzle delaying flow of compressed gas out of the piston chamber and through said gas inlet passage for a predetermined time after said contact separation, thereby enabling a substantial predetermined arc-length to be achieved between said stationary contact rod and said movable contact prior to unplugging said one nozzle, whereby compressed gas will then flow at this time through said one gas-inlet passage into the established arc for arc-extinction purposes.

2. The combination according to claim 1, wherein at least one of the separable contacts is vented so that gas may exhaust therethrough.

3. The combination of claim 2, wherein both separable contacts are hollow and vented, thereby enabling compressed gas to flow in opposite directions through said two separable vented contacts when they are separated.

4. The combination according to claim 1, wherein the multiple hollow insulating nozzle assembly includes three axially-spaced insulating hollow nozzles, said three axially-spaced insulating hollow nozzles defining a spaced pair of gas-inlet passages (52, 53).

5. The combination according to claim 1, wherein the multiple hollow insulating nozzle assembly consists only of two axially-spaced hollow insulating nozzles defining only one gas-inlet passage therebetween.

6. The combination of claim 1, wherein a round cluster of circumferentially-disposed flexible contactfingers are provided about the stationary contact rod, and an annular main metallic movable contact is included in the movable contact assembly for contacting engagement with said cluster of main contact fingers, thereby enabling a higher current-rating to be attributed to the circuit-interrupting structure.

7. The combination of claim 1, wherein a metallic cooler assembly including an annular apertured member also moves with the movable operating cylinder assembly, and the apertures in the cooler assembly align with the gas-inlet passage.

8. The combination of claim 7, wherein two sets of apertures are provided in the metallic cooler assembly, one inner set of apertures communicating with one gas-inlet passage and the outer set of apertures in the metallic cooler assembly communicating with a second gas-inlet passage.

9. The combination of claim 1, wherein a relatively short distance is provided between the multiple nozzle assembly and the piston-chamber so that a higher ratio of compressed gas may be achieved, and the oscillatory movement of the arcing gas may engender a higher gas pressure within the piston chamber.

10. The combination according to claim 1, wherein at least one of the nozzles is internally corrugated.

11. The combination according to claim 7, wherein the metallic cooler assembly additionally defines an annular movable main contact, a cluster of circumferentially-disposed stationary main contact fingers surrounds the relatively-stationary contact rod.

12. A puffer-type compressed-gas circuit-interrupter including a pair of separable contacts, one of which is a hollow venting tubular contact, separable to establish an arc, means defining a relatively-stationary piston structure, a movable operating cylinder assembly slidable over said relatively-fixed piston structure to compress gas therebetween, the movable operating cylinder-assembly including additionally a plurality of apertured axially-spaced nozzles, said nozzles encompassing the relatively-stationary contact in the closed-circuit position of the device, and the sliding movement of said insulating nozzles over the relatively-stationary contact during the opening operation providing a desirable valve-blocking action to prevent said compressed gas from flowing into the arc until the arc has attained a substantial predetermined length adequate for circuit interruption.

13. The combination according to claim 12, wherein two apertured nozzles are provided having an annular gas-flow passage therebetween.

14. The combination according to claim 13, wherein three apertured nozzles are provided having an axially-spaced pair of gas-inflow passages provided between the intermediate middle nozzle and the two outermost apertured nozzles.

15. The combination according to claim 12, wherein both separable contacts are vented.

16. The combination according to claim 12, wherein the relatively-stationary contact structure comprises a tubular vented stationary contact and a surrounding, circumferentially-arranged cluster of relatively-heavy stationary contact fingers, and the movable cylinder assembly includes a movable annular main-contact portion cooperable in the closed-circuit position of the device with the aforesaid cluster of relatively-heavy main stationary contact fingers.

17. The combination according to claim 12, wherein the relatively-fixed piston structure includes valve means for permitting the replenishing of gas within the compression chamber during the closing stroke of the circuit-interrupter.

18. The combination according to claim 12, wherein an apertured metallic cooler member moves with the movable operating cylinder-assembly, and cools the gas compressed within the compression region prior to its subsequent ejection into the arc.

19. The combination according to claim 16, wherein the relatively movable contact comprises a cluster of movable contact fingers which flexibly interengage the stationary tubular venting contact.

20. The combination according to claim 12, wherein all of the apertured nozzles have internally-disposed annular corrugations to increase the surface-creep distance through the nozzle aperture.

21. The combination according to claim 12, wherein the relatively-movable main contact is integrally formed with an apertured metallic cooler member attached to and movable with the movable operating cylinder-assembly.

22. The combination according to claim 12, wherein the valve means, associated with the relatively-stationary piston structure, comprises an annular valve-plate biased to the closed-valve position.

* * * * *